US007752737B2

(12) United States Patent
Edo et al.

(10) Patent No.: US 7,752,737 B2
(45) Date of Patent: Jul. 13, 2010

(54) METHOD FOR MANUFACTURING A POWDER MAGNETIC CORE

(75) Inventors: Masaharu Edo, Tokorozawa (JP); Takayuki Hirose, Sagamihara (JP); Akira Sato, Matsumoto (JP)

(73) Assignee: Fuji Electric Device Technology Co., Ltd., Tokyo (JP)

( * ) Notice: Subject to any disclaimer, the term of this patent is extended or adjusted under 35 U.S.C. 154(b) by 0 days.

(21) Appl. No.: 12/149,774

(22) Filed: May 8, 2008

(65) Prior Publication Data

US 2009/0007418 A1 Jan. 8, 2009

(30) Foreign Application Priority Data

Jul. 3, 2007 (JP) ..... 2007-175336

(51) Int. Cl.
*H01F 7/06* (2006.01)

(52) U.S. Cl. ..... 29/606; 29/605; 29/607; 29/609; 156/89.11; 156/89.12; 156/250; 336/176; 336/200; 336/229

(58) Field of Classification Search ..... 29/604–606, 29/607, 609; 156/89.11, 89.12, 250; 336/176, 336/200, 229

See application file for complete search history.

(56) References Cited

U.S. PATENT DOCUMENTS

| | | | | |
|---|---|---|---|---|
| 7,060,374 | B2 * | 6/2006 | Kobayashi et al. | 428/828 |
| 7,365,626 | B2 * | 4/2008 | Matsutani et al. | 336/200 |
| 2004/0238796 | A1 | 12/2004 | Abe | |

FOREIGN PATENT DOCUMENTS

| | | |
|---|---|---|
| JP | S56-38402 | 4/1981 |
| JP | H09-074016 | 3/1997 |
| JP | H10-064007 | 3/1998 |
| JP | H11-074140 | 3/1999 |
| JP | 2000-54083 | 2/2000 |
| JP | 2001-085211 | 3/2001 |

* cited by examiner

*Primary Examiner*—Paul D Kim
(74) *Attorney, Agent, or Firm*—Manabu Kanesaka

(57) ABSTRACT

In a method for manufacturing a powder magnetic core, magnetic layer green sheets is formed by using magnetic metal particles having an insulating oxide layer on a surface thereof, and insulating layer green sheets are formed by using insulating particles. The magnetic layer green sheet and the insulating layer green sheet are alternately laminated, and the layers are press molded.

5 Claims, 6 Drawing Sheets

METHOD FOR MANUFACTURING A POWDER MAGNETIC CORE

BACKGROUND OF THE INVENTION AND RELATED ART STATEMENT

The present invention relates to a powder magnetic core and a method for manufacturing same. The powder magnetic core is suitable for a transformer and a reactor for a switching power source.

Various electronic devices have been decreased in size and weight in recent years, and accordingly, a demand has increased for a miniaturization of switching power sources which are installed on electronic devices. In particular, there is a strong need for size and thickness reductions in switching power sources for use in laptop personal computers, small portable devices, thin CRT monitors, and flat panel displays. However, in the conventional switching power sources, magnetic components such as transformers and reactors, which are the main structural components thereof, take a large space, thereby limiting the reductions of size and thickness. Thus, the switching power sources are difficult to be reduced in size and thickness unless these magnetic components are made small and thin.

Metal magnetic materials such as Sendust and Permalloy or oxide magnetic materials such as ferrites have been used for magnetic components of transformers and reactors used in such switching power sources. Among them, the metal magnetic materials generally have a high saturation magnetic flux density and a magnetic permeability, but because an electric resistivity thereof is low, an eddy current loss becomes high, in particular, in a high-frequency region. Recently, a trend has been emerging towards a miniaturization of magnetic components by driving power circuits at a high frequency and decreasing a necessary inductance value, but because of the effect of eddy current loss, metal magnetic materials cannot be used at a high frequency.

On the other hand, because the oxide magnetic materials have an electric resistivity higher than that of the metal magnetic materials, the eddy current loss generated even in a high-frequency region is small. However, because the saturation magnetic flux density is small, such materials are easily magnetically saturated, thereby making it impossible to reduce their volumes. In other words, in any case, the magnetic core volume is the most significant factor determining the inductance value, and the size and thickness reductions are difficult to be attained unless the magnetic properties of magnetic materials are improved.

Thus, the possibilities for miniaturizing the conventional magnetic components are limited, and the requirements for the size and thickness reductions of electronic devices have not been fully met.

As a method for resolving these problems, a high-density sintered magnetic body has been suggested (see, for example, Japanese Unexamined Patent Application Publication No. 56-38402) in which a surface of a metal magnetic material composed of particles with a size of 1 to 10 μm is coated with a metal oxide magnetic material of a spinel composition represented by M-$Fe_xO_4$ (where M=Ni, Mn, Zn, $x \leqq 2$).

Further, for example, International Patent Application Publication No. 03/015109 and US Patent Application Publication No. 2004/0238796 A1 suggest a composite magnetic material in which a ferromagnetic fine particulate powder of a metal or an intermetallic compound having a layer of a ferrite layer formed by plating ultrasonically excited ferrite on a surface thereof is compression molded, and a magnetic circuit is formed between the ferromagnetic particles via the ferrite layer.

Further, soft magnetic particles have been suggested, and the soft magnetic particles are composed of soft magnetic metal particles, a high-resistance substance coated on a surface thereof, and a phosphate-based conversion layer formed on a surface of the high-resistance substance, so as to obtain a soft magnetic molded body with a high density and a high specific resistance (see, for example, Japanese Unexamined Patent Application Publication No. 2001-85211).

A magnetic material has recently been suggested in which a layer of a nonmagnetic insulating oxide with a high electric resistivity is formed on the surface of soft magnetic particles with a high saturation magnetic flux density and a magnetic permeability in order to increase a resistivity and resolve a drawback of metal magnetic materials. With such a magnetic material, because the electric resistivity is increased by an effect of a nonmagnetic insulating film, it is possible to inhibit eddy current, that is, it enables the use of the magnetic material at a high frequency, e.g. in a megahertz band.

In order to further decrease the eddy current loss in a megahertz band in a soft magnetic molded body obtained by molding the above-described particles (magnetic material), it is necessary to increase the resistivity of the soft magnetic molded body by increasing the thickness of the insulating layer or high-resistance layer formed on the surface of metal particles. For example, a specific resistance in the example illustrated by Table 1 of Japanese Unexamined Patent Application Publication No. 2001-85211 is higher than that in the comparative example, but it is still insufficient. Only a material with a volume iron loss of 10 kHz is shown. To enable the operation at 1 MHz, the specific resistance of the molded body has to be raised by further increasing the thickness of the high-resistance layer. However, where the thickness of the insulating layer or high-resistance layer formed on the surface of metal particles is increased, a gap between the metal particles becomes large, and a magnetic permeability decreases. Further, where the insulating layer is made thinner to increase the magnetic permeability or the heat treatment temperature of the soft magnetic molded body obtained by press molding is raised, the decrease in resistivity causes an increase in the eddy current loss in a megahertz band.

According to another method for further decreasing the eddy current loss within a megahertz band, the thickness of a press molded powder magnetic core is decreased, and they are laminated via insulating layers (see, for example, Japanese Unexamined Patent Application Publication No. 11-74140).

Further, methods for manufacturing a soft magnetic multilayer film have also been suggested in which a laminate of soft magnetic films and insulating films is formed by alternately laminating the soft magnetic films and insulating films (see, for example, Japanese Unexamined Patent Application Publication Nos. 2000-54083 and 9-74016).

With the method disclosed in Japanese Unexamined Patent Application Publication No. 11-74140, two rings with a thickness of 5.5 mm are laminated by hot pressing so as to obtain a thickness of 10 mm. However, in thin electronic components, the total thickness is as small as 0.6 mm or less, and the thickness of the laminated body is equal to or less than half of the total thickness (for example, 0.2 mm or less). To manufacture such a thin core by press molding is also difficult from the standpoint of a mechanical strength. The degree of difficulty becomes especially significant as the surface area of the core increases. Further, because the total thickness is small, when a method of laminating thin cores via insulating layers is used, the thickness of insulating layers has to be, for example, 0.05 μm or less, but such thin sheet-like cores are substantially difficult to produce by press molding.

Japanese Unexamined Patent Applications Publications No. 2000-54083 and No. 9-74016 describe laminated structures of magnetic films and insulating films which are suitable for magnetic cores of inductors and transformers, but because the magnetic films and insulating films in both patent applications are formed by sputtering or vapor deposition, the problem is that the film formation speed is low, a significant time is required to form the laminated structure, and the thick sheet structure such as a bulk core cannot be formed due to stresses.

It is an object of the present invention to resolve the above-described problems and to provide a method for manufacturing a structure in which thin cores and insulators are alternately laminated as a method for improving high-frequency characteristics of a powder magnetic core and decreasing the eddy current loss.

Further objects and advantages of the invention will be apparent from the following description of the invention.

SUMMARY OF THE INVENTION

The method for manufacturing a powder magnetic core in accordance with the present invention is a method for manufacturing a powder magnetic core by press molding soft magnetic metal particles having an insulating oxide layer on a surface thereof, said method comprising the steps of: a magnetic layer green sheet forming step for forming green sheets by using the soft magnetic metal particles having an insulating oxide layer on the surface thereof; an insulating layer green sheet forming step for forming green sheets by using insulating particles; and a press molding step for alternately laminating the magnetic layer green sheets obtained in the magnetic layer green sheet forming step or laminated magnetic layer green sheets obtained by laminating a predetermined necessary number of the magnetic layer green sheets and the insulating layer green sheets obtained in the insulating layer green sheet forming step and press molding the alternately laminated magnetic layer green sheets and the insulating layer green sheets.

The powder magnetic core in accordance with the present invention is obtained by the above-described method for manufacturing the powder magnetic core.

In accordance with the present invention, the laminated powder magnetic core having magnetic layers and insulating layers laminated therein can be easily formed, and a high-frequency characteristic of the magnetic core can be improved.

DETAILED DESCRIPTION OF THE PREFERRED EMBODIMENTS

Figure 1:
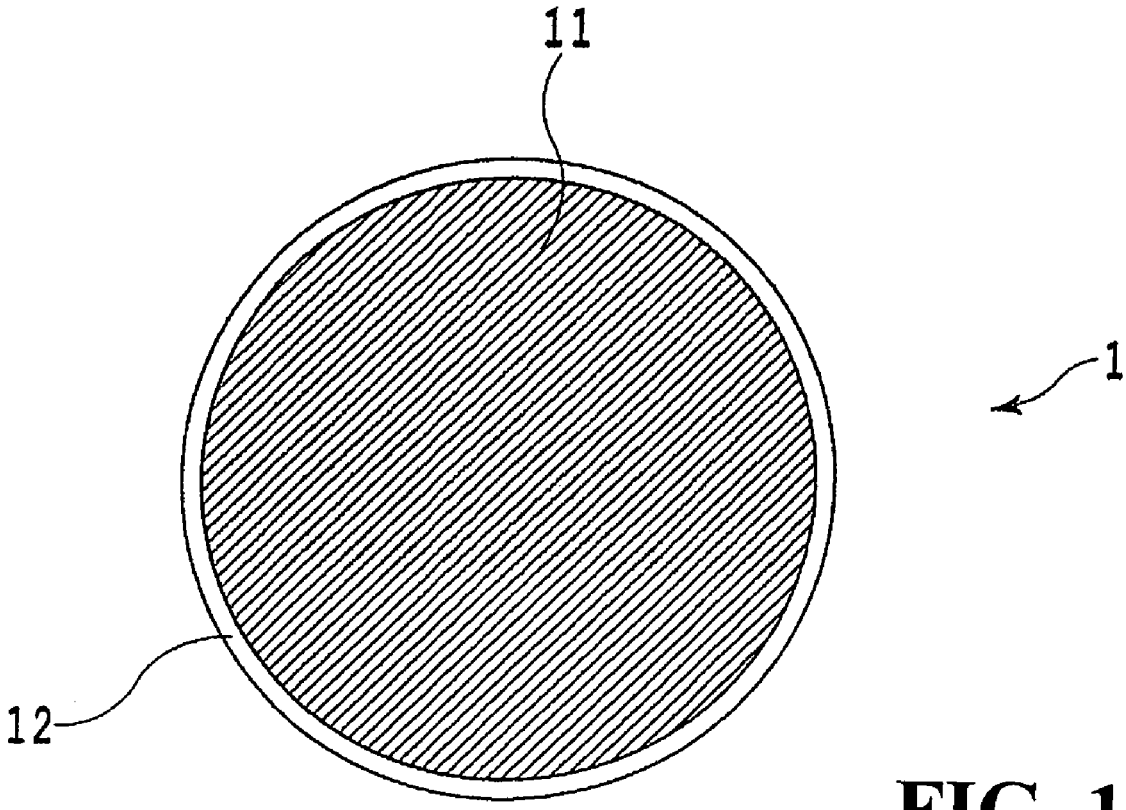
FIG. 1 is a schematic drawing illustrating a soft magnetic metal particle provided with an insulating oxide layer.

In accordance with the present invention, a magnetic layer green sheet is formed by using soft magnetic metal particles 1 provided with an insulating oxide layer in which an insulating oxide layer 12 is formed on soft magnetic metal particles 11 as shown in FIG. 1.

Particles composed of metal materials with a high magnetic permeability, for example, metals such as iron, cobalt, and nickel or alloys made thereof, such as Permalloy and Sendust, can be used as the metals in the soft magnetic metal particles 1 provided with the insulating oxide layer which are used for forming the magnetic layer green sheet.

A diameter of the soft magnetic metal particles 11 is not particularly limited, but the preferred diameter is 1 to 30 μm.

Examples of oxides forming the insulating oxide layer on the surface of soft magnetic metal particles include oxides with a high electric resistivity such as ferrites and iron-based oxides, and insulating oxides such as glass, silica, and alumina. Examples of suitable ferrites include Ni—Zn ferrites, Cu—Zn—Mg ferrites, and composite ferrites containing these as the main components. Examples of glass include glass containing $SiO_2$, $B_2O_3$, $P_2O_5$, or the like as the main component. A method for forming the insulating oxide layer is not limited to a wet method, but a dry method can be also employed. Thus, a method for forming the layer is not particularly limited.

The thickness of layer of the metal magnetic particles provided with insulating oxide layer is not particularly limited, but it may be 5 nm or more, more preferably 10 nm or more, provided that an electric resistance between the particles can be increased. From the standpoint of an increasing magnetic permeation, a thickness of 40 nm or less, more preferably 20 nm or less is preferred.

Figure 5:
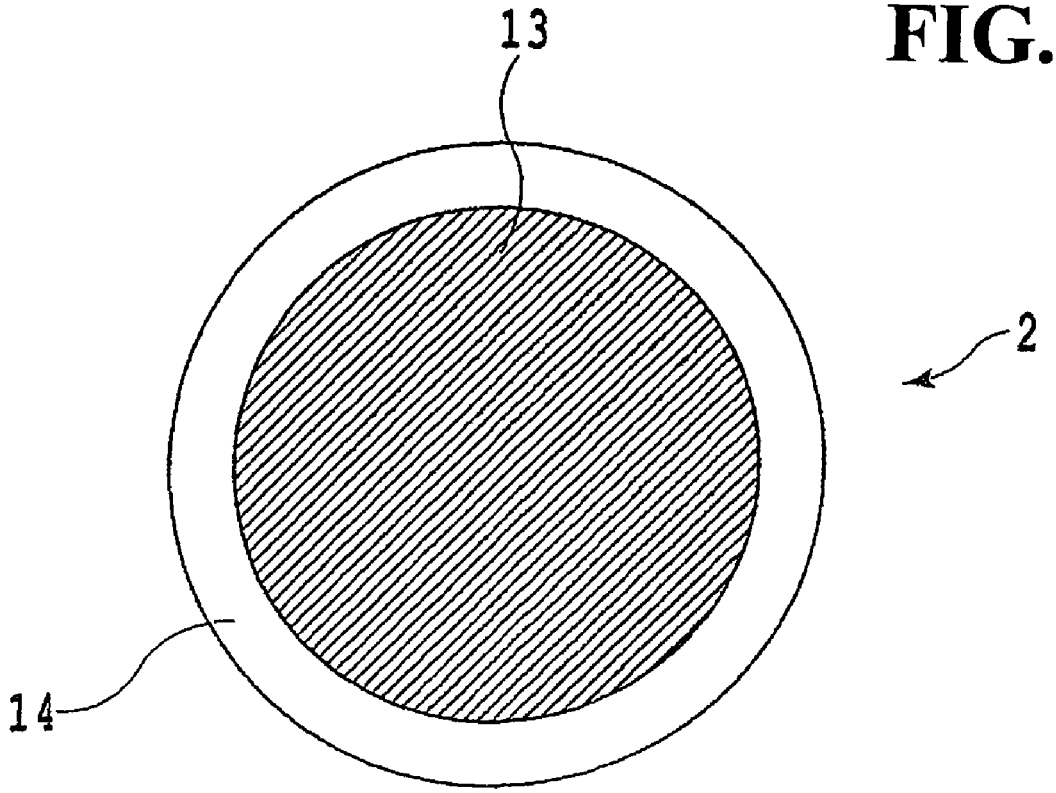
FIG. 5 is a schematic drawing illustrating a soft magnetic metal particle provided with a thick insulating oxide layer which is used in example 3 of the present invention.

Oxides with a high electric resistivity such as ferrites and iron-based oxides, and insulating oxides such as glass, silica, and alumina can be used as the insulating particles which form the insulating layer green sheets, but from the standpoint of improving magnetic characteristics of the obtained powder magnetic core, it is preferable to use soft magnetic metal particles 2 provided with an insulating oxide layer in which a thick insulating oxide layer 14 is formed on soft magnetic metal particles 13 as shown in FIG. 5.

Particles, which are identical to the soft magnetic metal particles in soft magnetic metal particles 1 provided with an insulating oxide layer which are used for forming the magnetic layer green sheets, can be used as soft magnetic metal particles suitable for soft magnetic metal particles 2 provided with a thick insulating oxide layer which form the insulating layer green sheets. Examples of oxides which form the thick insulating oxide layer 14 include oxides with a high electric resistivity such as ferrites and iron-based oxides, and insulating oxides such as glass, silica, and alumina. Examples of suitable ferrites include Ni—Zn ferrites, Cu—Zn—Mg ferrites, and composite ferrites containing these ferrites as the base components. Examples of glass include a glass containing $SiO_2$, $B_2O_3$, $P_2O_5$, or the like as the main component.

A thickness of the insulating oxide layer 14 in the soft magnetic metal particles 2 provided with a thick insulating oxide layer is preferably 50 to 300 nm. When the thickness is less than the lower limit presented above, the insulating properties are insufficient, and when the thickness exceeds the upper limit, the decrease in the percentage of magnetic materials causes a problem of degraded characteristics and significantly long time required for the layer forming step.

The green sheet as referred to in the present invention is a sheet prior to a heat treatment in a case where the magnetic layers or insulating layers are formed by using the soft magnetic metal particles provided with the insulating oxide layer or insulating particles. The magnetic layer green sheet is obtained by adding a resin binder or a solvent to the soft magnetic metal particles provided with an insulating oxide layer to obtain a slurry, and molding a sheet of a predetermined thickness by using the slurry. The insulating layer green sheet is obtained by adding the resin binder or the solvent to the insulating particles to obtain the slurry and molding a sheet of a predetermined thickness by using the slurry. Binder resins such as polyvinyl alcohol and resins of a butyral type, cellulose type, and acryl type can be used as the resin binder. Examples of suitable solvents include organic solvents such as petroleum-derived solvents, alcohols, acetone, and toluene, and water. A thickness of the magnetic layer green sheet is preferably 20 to 200 μm after drying, and a thickness of the insulating layer green sheet is preferably 5 to 100 μm after drying.

When green sheets are manufactured by using the slurry, any sheet formation technology can be used, but from the standpoint of facilitating the formation of a large surface area, it is preferred that the sheet be formed by a doctor blade method.

Figure 2:
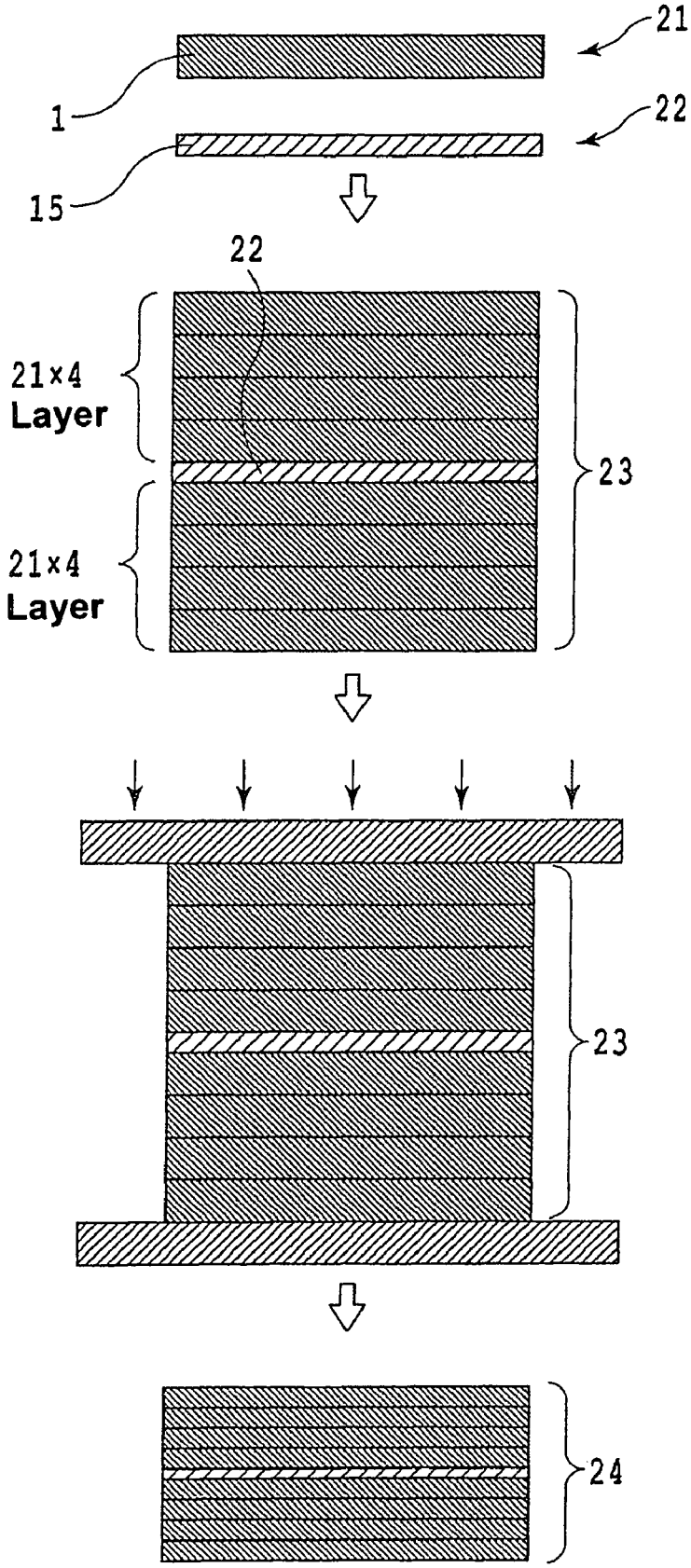
FIG. 2 is a schematic drawing illustrating a process of manufacturing a powder magnetic core of example 1 of the present invention.

Then, a powder magnetic core is manufactured by a following procedure as shown in FIG. 2. Namely, the magnetic layer green sheets or laminated magnetic layer green sheets obtained by laminating a predetermined necessary number of the magnetic layer green sheets and the insulating layer green sheets are alternately laminated. In the embodiment shown in FIG. 2, a laminated green sheet 23 with a total thickness of 820 μm is formed by laminating four green sheets 21 serving as the above-described magnetic layers, then one green sheet 22 serving as the insulating layer, and then four green sheets 21 serving as magnetic layers.

A powder magnetic core can be produced by press molding the laminated green sheet thus obtained. In the example shown in FIG. 2, the green sheet is molded by being sandwiched between flat plates having no frame, but if necessary a mold may be used. A press pressure is preferably 500 to 2000 MPa.

The laminated powder magnetic core thus obtained is heat treated. A heat treatment temperature is preferably 300 to 800° C. The heat treatment is performed, for example, by using an electric furnace. The atmosphere during heat treatment affects an oxidation of metal particles. Therefore, where the oxidation is permitted, the heat treatment may be carried out in the air. Where the oxidation is undesirable, the heat treatment may be carried out in vacuum or in an inactive gas such as nitrogen or argon. Where a reduction is desired, the heat treatment may be carried out in a hydrogen atmosphere.

If necessary, the laminated powder magnetic core subjected to heat treatment is processed to obtain a predetermined shape. Where the magnetic core may be used in a state obtained by forming in a mold, no processing is required. The manufacturing method in accordance with the present invention makes it possible to obtain a powder magnetic core with a low loss even at a high frequency.

The present invention will be explained below in greater detail by using examples thereof.

Example 1

In the present example, Ni78Mo5Fe (Ni is 78 wt. %, Mo is 5 wt. %, and Fe is the balance) particles (mean particle size is 8 μm) produced by a water atomizing method were used as the soft magnetic metal particles 11. Further, a $SiO_2$ layer formed by a water glass method was used as the insulating oxide layer 12. A method for forming the layer is described below.

A composition of water glass used in the example as $Na_2O.xSiO_2.nH_2O$ (x=2 to 4), and a solution obtained by dissolving it in water demonstrated alkaline property. The soft magnetic metal particles 11 were placed into the solution, hydrochloric acid was added to the solution, hydrolysis was conducted under pH control, and gel-like silicic acid ($H_2SiO_3$) was caused to adhere to a surface of soft magnetic metal particles 11. A $SiO_2$ layer was then formed by drying the soft magnetic metal particles 11. A thickness of the $SiO_2$ layer can be controlled by adjusting a concentration of aqueous solution of water glass, and in the present example, the thickness was controlled to 20 nm.

In the present example, the laminated powder magnetic core was manufactured by the manufacturing method shown in FIG. 2.

First, magnetic layer green sheets 21 were formed by using the above-described soft magnetic metal particles 11 provided with an oxide layer as the main materials. A typical method similar to a method for forming green sheets of ferrites or ceramics was employed as a method for manufacturing the green sheets. Aqueous solution of PVA (polyvinyl alcohol, 0.1 wt. %) was used as the binder and mixed with the metal magnetic particles. The mixture was deformed and then formed by a doctor blade method to a thickness of 100 μm after drying.

The insulating layer green sheet 22 was then formed by a similar process. $SiO_2$ particles 15 (mean particle diameter 2 μm) were used as materials therefor, a binder similar to the above-described binder was mixed therewith, and the mixture was formed to obtain a thickness of 20 μm after drying.

The laminated green sheets were press molded without using a mold under a pressure of 1176 MPa (12 ton/cm$^2$), and a laminated powder magnetic core 24 having the insulating layer in the center and the magnetic layers above and below the insulating layer was formed. The sheet thickness after press molding was 532 μm.

Then, a laminated green sheet 23 with a total thickness of 820 μm was formed, as shown in FIG. 2, by laminating four layers of the above-described magnetic layer green sheets, one layer of the insulating layer green sheet, and further four layers of the magnetic layer green sheets.

The powder magnetic core thus obtained was heat treated in an electric furnace for one hour at a temperature of 600° C. in a nitrogen atmosphere. The heat treatment was carried out in the nitrogen atmosphere. Finally, the heat-treated powder magnetic core was processed to obtain a predetermined structure.

Figure 4:
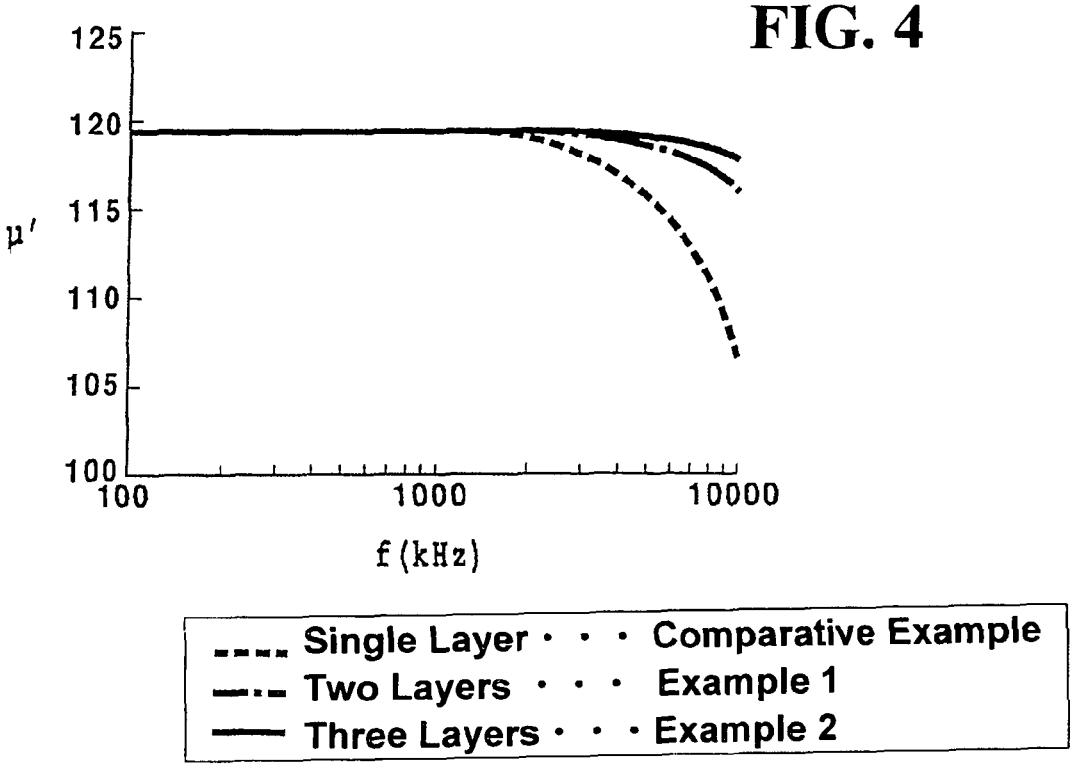
FIG. 4 shows frequency characteristics of powder magnetic cores produced in examples 1, 2 of the present invention.
Figure 4:
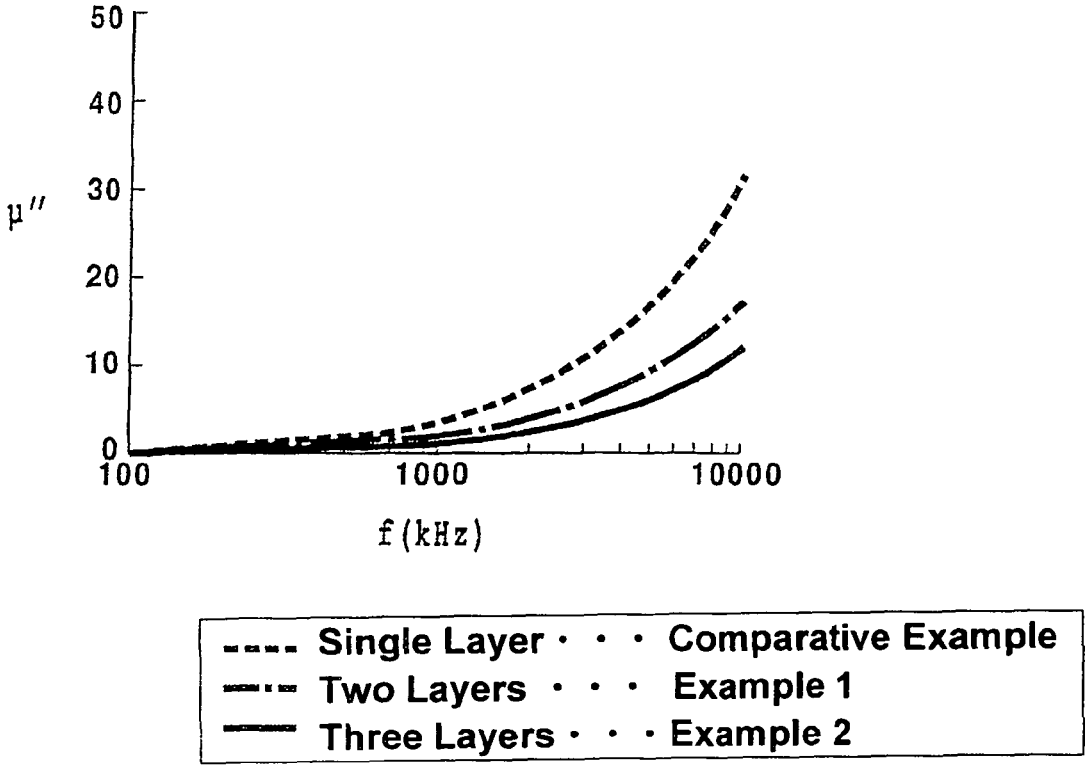

The powder magnetic core thus obtained demonstrated the following performance: a saturation magnetization of 0.59 T, an effective permeability $\mu'=100$ at a frequency f=2 MHz, and $\tan\delta=\mu''/\mu'=0.015$. The frequency characteristics of the $\mu'$ and $\mu''$ of the laminated powder magnetic core are shown in FIG. 4. For comparison, characteristics of a powder magnetic core formed to a thickness of 525 μm by using metal particles provided with an insulating layer which are identical to those used in the magnetic layer green sheets, but without forming the insulating layer, are also shown in FIG. 4.

Example 2

Figure 3:
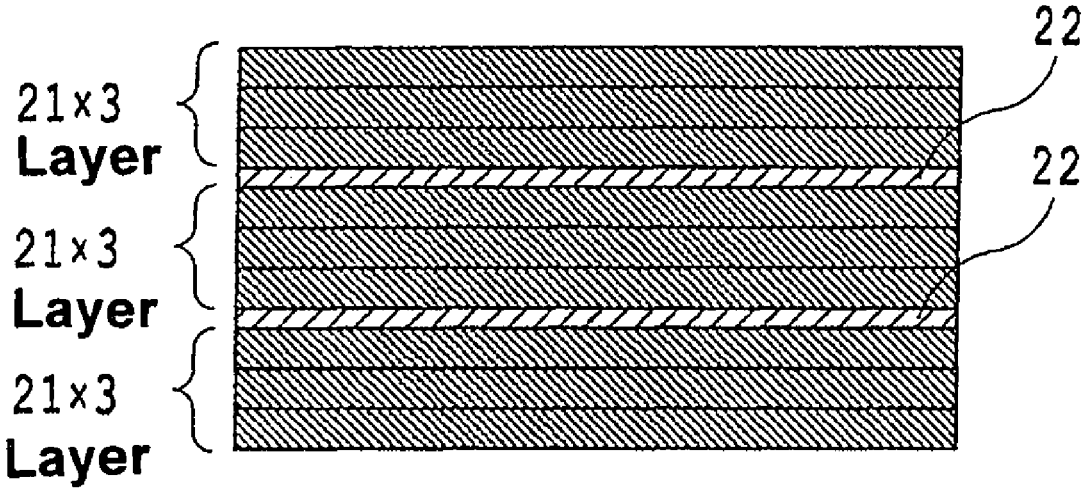
FIG. 3 is a structural schematic drawing of the powder magnetic core produced in example 2 of the present invention.

In the present example, a powder magnetic core of a three-layer structure such as shown in FIG. 3 was produced. The production method was identical to that of Example 1 shown in FIG. 2, but the thicknesses of the magnetic layer green sheets after drying were 90 μm/layer, the thickness of the insulating layer green sheet after drying was 20 μm, lamination was performed in the order of three magnetic layers, one insulating layer, three magnetic layers, one insulating layer, and three magnetic layers. Pressing and heat treatment were performed in the same manner as in Example 1.

The thickness of the laminated powder magnetic core was 550 μm. The powder magnetic core thus obtained demonstrated the following performance: a saturation magnetization of 0.58 T, an effective permeability $\mu'=100$ at a frequency f=2 MHz, and $\tan\delta=\mu''/\mu'=0.007$.

Example 3

In the present example, an insulating magnetic layer green sheet formed by using soft magnetic metal particles 2 (referred to hereinbelow as particles 2) provided with a thick insulating oxide layer that has a thick insulating oxide layer 14 on the surface of soft magnetic metal particles 13 such as shown in FIG. 5 was used instead of the insulating layer green sheet.

In the particles 2, similarly to particles 1, Ni78Mo5Fe particles (mean particle size 8 μm) produced by a water atomizing method were used as the soft magnetic metal particles 13, and a $SiO_2$ layer formed by a water glass method by controlling the thickness to 200 nm by was used as the insulating oxide layer 12.

An insulating magnetic layer green sheet was formed by the same method as that of the green sheet forming step of Example 1 by using the particles 2 which have been thus obtained. The thickness after drying was adjusted to 50 μm.

Magnetic layer green sheets identical to those used in Example 1 were used as the magnetic layer green sheets employed in the present example. In the present example, a laminated green sheet with a total thickness of 850 μm was formed by laminating four layers of magnetic layer green sheets, one layer of the insulating magnetic layer green sheet, and four layers of the magnetic layer green sheets. Then, the laminated green sheet was subjected to press molding and heat treatment at a temperature of 500° C. to form a laminated powder magnetic core. The sheet thickness after press molding was 550 μm.

Figure 6:
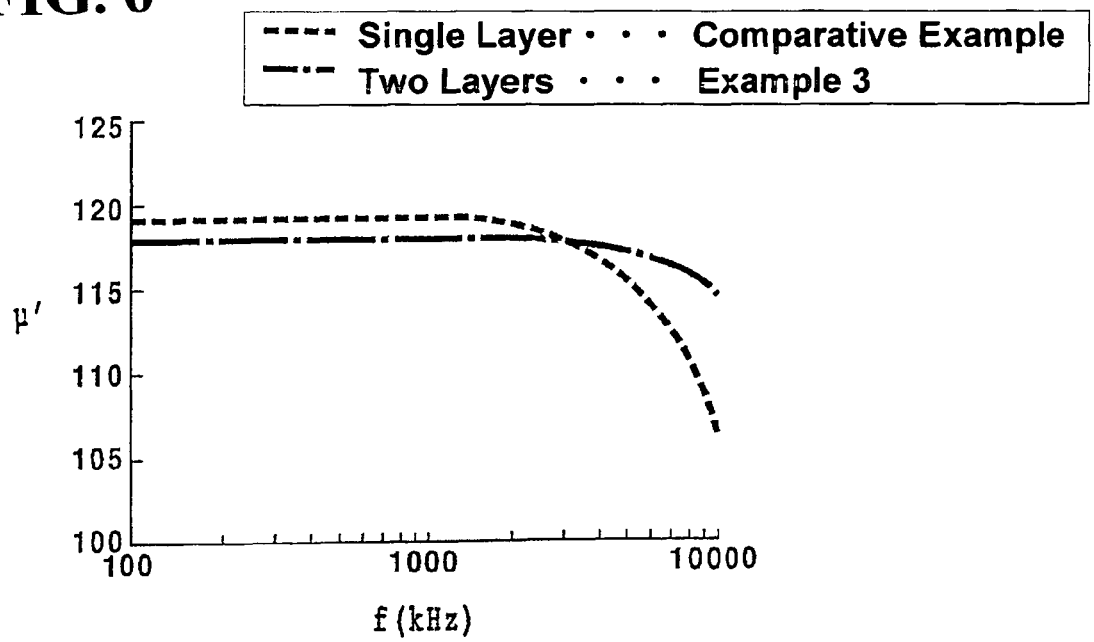
FIG. 6 shows a frequency characteristic of powder magnetic core produced in example 3 of the present invention.
Figure 6:
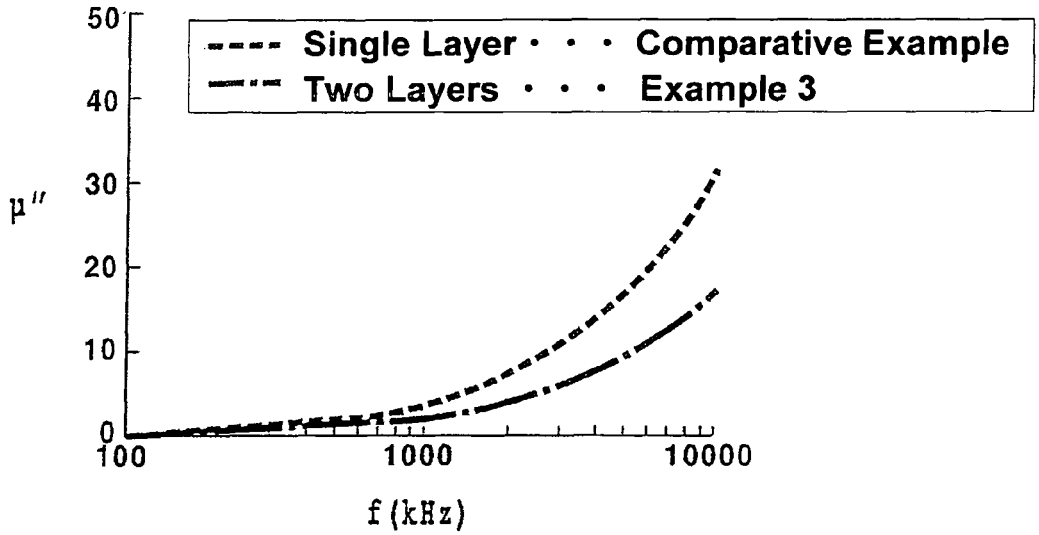

The laminated powder magnetic core thus obtained demonstrated the following performance: a saturation magnetization of 0.61 T, an effective permeability $\mu'=98$ at a frequency f=2 MHz, and $\tan\delta=\mu''/\mu'=0.015$. The frequency characteristics of the $\mu'$ and $\mu''$ of the laminated powder magnetic core are shown in FIG. 6. For comparison, characteristics of a powder magnetic core formed to have a thickness of 525 μm by using metal particles provided with an insulating layer which are identical to those used in the magnetic layer green sheets, but without forming the magnetic insulating layer, are also shown in FIG. 6.

The comparison of Example 1 and Example 3 demonstrates that, by using soft metal particles provided with an oxide insulating layer, instead of using particles composed of $SiO_2$, as particles for forming the insulating layer green sheet, it is possible to further improve the saturation magnetization, while maintaining the frequency characteristic. In these examples, a, structure with two, upper and lower, magnetic layers was employed, but using three layers can further improve the high-frequency characteristic, as described in Example 2.

In accordance with the present invention, the laminated powder magnetic core in which magnetic layers and insulating layers are laminated can be formed in an easy manner, and a high-frequency characteristic of the magnetic core can be improved. By using such a magnetic core, it is possible to reduce a size and a thickness of a switching power source.

The disclosure of Japanese Patent Application No. 2007-175336, filed on Jul. 3, 2007, is incorporated in the application.

While the invention has been explained with reference to the specific embodiments of the invention, the explanation is illustrative and the invention is limited only by the appended claims.

What is claimed is:

1. A method for manufacturing a powder magnetic core, comprising the steps of:

forming magnetic layer green sheets by using magnetic metal particles having an insulating oxide layer on a surface of each of the magnetic metal particles;

forming an insulating layer green sheet by using insulating particles;

alternately laminating at least one of the magnetic layer green sheets, and the insulating layer green sheet; and press molding the layers obtained by the laminating step, wherein the insulating particles forming the insulating layer green sheet is magnetic metal particles having an insulating oxide layer, and a thickness of the insulating oxide layer for forming the insulating layer green sheet is greater than that of the insulating oxide layer of the magnetic metal particles forming the magnetic layer green sheet.

2. The method for manufacturing a powder magnetic core according to claim 1, wherein the magnetic layer green sheets are laminated with the insulating layer green sheet.

3. The method for manufacturing a powder magnetic core according to claim 1, wherein the magnetic metal particles of the magnetic layer green sheets are selected from the group consisting of iron, cobalt, nickel, Permalloy, and Sendust, and have a particle diameter of 1-30 μm.

4. The method for manufacturing a powder magnetic core according to claim 3, wherein the insulating oxide layer on the magnetic metal particles of the magnetic layer green sheets is formed by ferrite, iron-based oxide, glass, silica or alumina.

5. The method for manufacturing a powder magnetic core according to claim 1, wherein the insulating particles for the insulating layer green sheet are made of particles of ferrite, iron-based oxide, glass, silica or alumina.

* * * * *